United States Patent [19]

Hansler

[11] 4,170,744

[45] Oct. 9, 1979

[54] COMBINATION DISCHARGE-INCANDESCENT LAMP WITH THERMAL SWITCH CONTROL

[75] Inventor: Richard L. Hansler, Pepper Pike, Ohio

[73] Assignee: General Electric Company, Schenectady, N.Y.

[21] Appl. No.: 885,313

[22] Filed: Mar. 10, 1978

[51] Int. Cl.[2] ..... H05B 39/10; H05B 41/46

[52] U.S. Cl. ..... 315/90; 315/74; 315/88; 315/100

[58] Field of Search ..... 315/73, 74, 88, 90, 315/91, 92, 93, 100

[56] References Cited

U.S. PATENT DOCUMENTS

| | | | |
|---|---|---|---|
| 2,513,840 | 7/1950 | Berland et al. | 315/73 X |
| 2,714,689 | 8/1955 | Waguet | 315/92 |
| 2,899,583 | 8/1959 | Macksoud | 315/109 |
| 3,611,432 | 10/1971 | Babcock | 315/92 |
| 3,679,931 | 7/1972 | Powell | 315/92 |
| 3,693,045 | 9/1972 | Price | 315/91 |
| 4,005,331 | 1/1977 | Horowitz | 315/92 |
| 4,047,076 | 9/1977 | McNamara, Jr. | 315/92 |
| 4,117,370 | 9/1978 | Jacobs et al. | 315/73 |

*Primary Examiner*—Saxfield Chatmon, Jr.
*Attorney, Agent, or Firm*—Ernest W. Legree; Lawrence R. Kempton; Frank L. Neuhauser

[57] ABSTRACT

A combination lamp comprises a miniature arc tube, a standby filament and a thermal switch in a sealed vitreous envelope. The switch is connected in series with the filament, and the arc tube and the filament have separate inleads for external connections. The switch is closed at room temperature, allowing the filament to light up immediately at a cold start and providing an instant-on feature. During normal operation, heat and light radiated by the arc tube cause the switch to open and turn off the filament. The small size of the arc tube favors a heat balance which allows the thermal switch to cool and reclose quickly in the event of a current interruption, thereby assuring lighting after an acceptably brief delay in the event of a hot restart.

5 Claims, 1 Drawing Figure

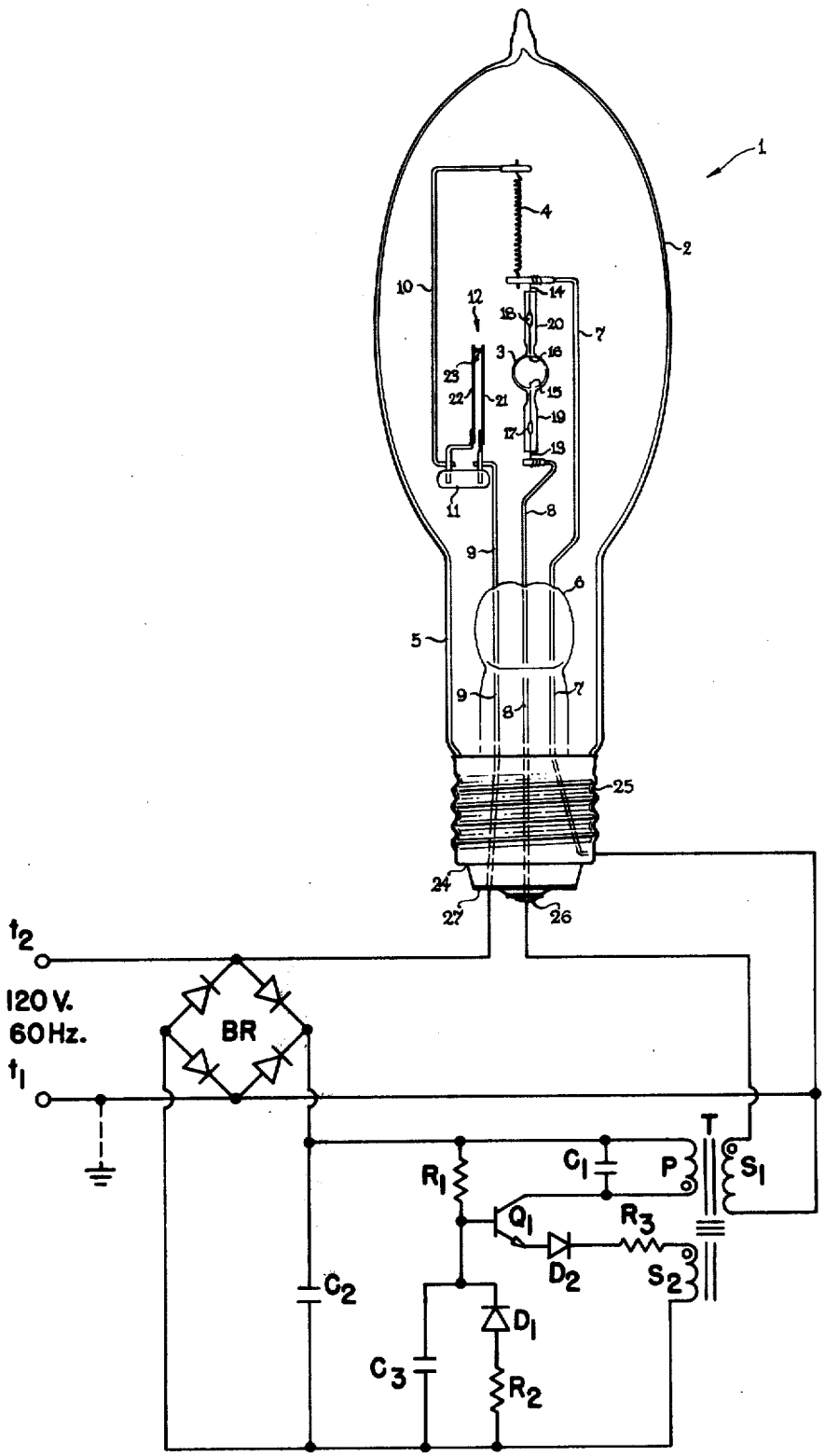
1
2
3
4
5
6
7
8
9
10
11
12
13
14
15
16
17
18
19
20
21
22
23
24
25
26
27
t2
120 V.
60 Hz.
t1
BR
R1
C1
P
T
S1
Q1
R3
D2
S2
C2
D1
C3
R2

COMBINATION DISCHARGE-INCANDESCENT LAMP WITH THERMAL SWITCH CONTROL

The invention relates to a lamp combining a miniature arc tube and a standby filament together with a thermal switch which assures instant lighting in the event of a cold start, and lighting after an acceptably brief delay in the event of a hot restart.

BACKGROUND OF THE INVENTION

In copending application Ser. No. 912,268, filed June 5, 1978 by Daniel M. Cap and William H. Lake, titled HIGH PRESSURE METAL VAPOR DISCHARGE LAMPS OF IMPROVED EFFICACY, which is a continuation-in-part of an earlier application Ser. No. 812,479, filed July 5, 1977, similarly assigned, useful and efficient high pressure discharge lamps are disclosed having much smaller sizes than have been considered practical heretofore, namely discharge volumes of one cubic centimeter or less. In preferred form achieving maximum efficacy, these high intensity lamps utilize generally spheroidal thin-walled arc chambers together with vapor pressures above 5 atmospheres and reaching progressively higher levels as the size is reduced. The convective arc instability usually associated with the high pressures utilized is avoided and there is no appreciable hazard from possibility of explosion. Practical designs provide wattage ratings or lamp sizes starting at about 100 watts and going down to less than 10 watts, the lamps having characteristics including color rendition, efficacy, maintenance and life duration making them suitable for general lighting purposes.

High pressure metal vapor lamps have certain inherent shortcomings which persist even in miniature sizes. One of these is the delay in achieving full brightness after ignition, caused by the need to heat up the envelope and vaporize the metallic fill. This delay may be termed the cold start delay. Another is the even longer delay, termed the hot restart delay, which occurs should there be a momentary interruption of power to the lamp. The interruption may be due to a line outage, as frequently caused by lightning, or to a person switching off the lights and then changing his mind. The lamp then becomes extinguished and relighting will not occur immediately upon restoration of power. It is necessary first for the lamp to cool down and the metal vapor pressure to diminish before the ballast can restrike the arc, and then more time is required for the arc tube to heat up to full brilliance.

It is known to use a separate standby incandescent lamp in combination with a discharge lamp and a control circuit to supplement the light from the discharge lamp during its off or low illumination periods and thereby achieve instant light. Such a system is disclosed in Swiss Pat. No. 377,937 (Leuenberger, 1964) in which the standby lamp is energized by a relay whose winding receives two oppositely directed voltages derived from the circuit of a mercury vapor lamp. During both the cold start and the hot restart intervals, the vector difference of the two voltages is large enough to energize the relay and switch on the standby lamp, while during normal operation, the vector difference is too small and the standby lamp remains switched off. Another example is described in Swiss Pat. 444,305 (Vogeli, 1967) wherein the relay is replaced by a silicon controlled rectifier connected in series with the standby lamp across the power supply. Yet other examples are disclosed in U.S. Pat. No. 3,517,254 (McNamara, Jr., 1970) which uses a diac connected in series with the standby lamp to control the current flow through it, and U.S. Pat. No. 3,737,720 (Willis, 1973) which uses a pair of relays for the control function. In all of these prior art systems, the control circuitry is relatively elaborate and expensive.

It is also known to mount an arc tube and a filament in a sealed vitreous envelope wherein the filament serves as a ballast for the arc tube. A well-known example is the common household type sun lamp which includes a ballast filament and a filamentary electrode within the arc tube connected in series with the arc gap, along with a thermal switch which starts the lamp by short-circuiting the filamentary electrode. Another example is described in U.S. Pat. No. 2,899,583 (Macksoud, 1959) and comprises an arc tube and a filament including two portions all connected in series within a sealed vitreous envelope. The arc tube starts with both filament portions connected in series, but during normal operation heat from the arc tube causes a thermal switch to close and short circuit one of the portions. Such prior art lamps using a filament within the sealed outer envelope for a ballast are relatively low efficacy lamps. Although the ballasting filament in these lamps does give some light, it is generally operated at a low temperature in order to lengthen its life and make it more commensurate with that of the arc tube which may exceed 5,000 hours. As a result, the filament does not give much light and does not truly perform the role of a standby light source assuring substantially immediate light when the lamp is switched on, or a quick relighting in the event of an interruption.

SUMMARY OF THE INVENTION

The object of the invention is to provide a new and improved lamp of inexpensive construction comprising a miniature high pressure metal vapor arc tube and a standby filament in a sealed vitreous envelope which will have high efficacy together with the features of instant light at a cold start, and light after an acceptably brief interval in the event of a hot restart.

A combination lamp embodying the invention comprises a miniature metal vapor arc tube having a discharge volume of one cubic centimeter or less, a standby filament and a thermal switch in a sealed vitreous envelope. The arc tube and the filament may have one common inlead, but each has its own inlead for the opposite side to permit separate external connections. The thermal switch is connected in series with the filament and is normally closed at room temperature. This allows the filament to light up immediately upon a cold start and provides an instant-on feature. Heat and light radiated by the arc tube cause the switch to open whereby the filament is turned off during normal operation. The small size of the arc tube favors a dynamic heat balance which allows the thermal switch to cool and reclose quickly in the event of a current interruption, thereby assuring lighting after an acceptably brief delay in the event of a hot restart.

DESCRIPTION OF DRAWING

The single FIGURE of the drawing shows in side elevation a combination discharge-incandescent lamp embodying the invention, and a schematically illustrated high frequency ballast circuit connected thereto.

DETAILED DESCRIPTION

Referring to the drawing, a combination discharge incandescent lamp 1 embodying the invention is illustrated comprising an outer glass envelope or jacket 2 within which are mounted an inner lamp envelope or arc tube 3 and a tungsten filament 4. The outer envelope includes a neck portion 5 which is closed by a reentrant stem 6 through which extend hermetically three inleads. Inleads 7 and 8 and their extensions support arc tube 3 in a vertical or axial attitude near the center of the bulb portion of the envelope. The filament 4 is axially mounted above the arc tube and extends from inlead 7 to a support rod 10 which is secured to inlead 9 by means of an insulating glass bead 11. Thermal switch 12 electrically interposed between the filament and inlead 9 is also supported by the glass bead. The space within outer envelope 2 may be filled with an inactive gas such as nitrogen to prevent oxidation of the filament or of fine inleads 13, 14 emerging from the arc tube. Also nitrogen helps to prevent arcing at the switch contacts or between inleads. Alternatively, the space within the outer envelope may be evacuated if desired in order to reduce the heat loss from the arc tube.

The arc tube 3 is made of quartz or fused silica, suitably by the expansion and upset of quartz tubing while heated to plasticity. Pin-like electrodes 15, 16 of tungsten extend into the arc tube and are joined to fine inlead portions 13, 14 by foliated portions 17, 18 preferably of molybdenum. The foliated portions are wetted by the fused silica of nect portions 19, 20 of the bulb to assure hermetic sealing. The arc tube 3 is typical of the discharge envelope proper of a miniature metal halide lamp. As illustrated, the wall thickness of the bulb portion is about 0.5 mm, the internal diameter is about 6 mm, and the arc chamber volume is approximately 0.11 cc. An arc tube of this size may have a rating of about 30 watts and a suitable filling therefor comprises argon at a pressure of 100 to 120 torr, 4.3 mg of Hg, and 2.2 mg of halide salt consisting of 85% NaI, 5% $ScI_3$ and 10% $ThI_4$ by weight. Such quantity of mercury, when totally vaporized under operating conditions, will provide a density of about 39 mg/cm$^3$ which corresponds to a pressure of about 23 atmospheres at the operating temperature of the lamp.

The thermal switch 12 consists of two metal strips 21, 22 attached to support wires seized in glass bead 11. At least one of the metal strips, suitably 21 in the illustration, consists of thermostat metal, that is a composite of two or more metallic layers of different coefficients of expansion permanently bonded together. A nickel-iron alloy is commonly used for the low expansion component and a nickel-chrome steel alloy for the high expansion component. When the temperature is raised, the relative lengths of the two components change causing the material to curve or bend. The strips have contacts 23 which engage in the rest or room temperature condition of the switch. The strips are resilient and are biased together to make good contact under this condition and provide circuit continuity from inlead 9 to filament 4. The thermal switch extends and is juxtaposed alongside arc tube 3 and the proximity of strip 21 to the bulb of the arc tube assures that it is heated rapidly when the arc tube is ignited. At such time strip 21 bends toward the arc tube and a gap opens between contacts 23 which breaks the circuit to the filament and turns it off.

As illustrated the lamp is provided with a so-called three-way base 24 fastened to the end of the neck but other types of bases may be used. The base includes a threaded metal shell 25 to which inlead 7 which serves as a common return for the arc tube and the filament is connected, an eyelet or end contact 26 to which inlead 8 is connected, and an intermediate ring contact 27 to which inlead 9 leading to the switch and to filament 4 is connected. The lamp may be operated from a conventional reactance ballast on a 60 hertz supply by connecting the ground or common side of the ballast to the base shell 25, the high side of the ballast secondary to end contact 26, and the high side of the ballast primary to ring contact 27. However, miniature metal vapor lamps are subject to very rapid deionization which causes reignition problems requiring high open circuit voltages from conventional 60 hertz ballasts. In order to avoid this, it is preferable to operate such lamps by means of a high frequency ballast at a frequency within the range from 20 to 50 kilohertz. Such circuits in general comprise a power oscillator with current limiting means coupled to the lamp, that is to the arc tube proper. Typical circuits use solid state control devices and ferrite core transformers or inductors; they may be made compact enough for direct attachment to the lamp at the utilization point, that is at the electrical outlet or socket or may be integrally joined to the lamp to make a so-called screwin unit.

The example of a compact high frequency ballasting circuit illustrated in the drawing takes the form of a blocking oscillator. A full wave bridge rectifier BR connected across 120 volt, 60 hertz line terminals $t_1$, $t_2$ provides rectified DC power to drive the inverter. Filter capacitor $C_2$ connected across the bridge's output terminals provides sufficient smoothing action to avoid reignition problems due to line frequency modulation of the high frequency output. A ferrite core transformer T has a primary winding P, a secondary high voltage winding $S_1$ and a feedback winding $S_2$. All the windings are magnetically linked and the winding sense is conventionally indicated by a dot at the appropriate end of the windings. The leakage reactance between primary and secondary is conventionally indicated by lines transverse to the principal core lines. A common connection to base shell 25 is made from one side of the line, preferably the low side indicated by a dotted ground connection next to terminal $t_1$, and from one side of secondary winding $S_1$. The other side of the secondary is connected to end contact 26 which places the arc tube across secondary winding $S_1$. The other side of the line, normally the high side corresponding to terminal $t_2$, is connected to ring contact 27 which effectively applies line voltage to the thermal switch and filament circuit.

Within the blocking oscillator the primary winding P, the collector-emitter path of transistor $Q_1$, and the feedback winding $S_2$ all connected in series form the principal primary current path. In that path $R_3$ is a current limiting resistor and diode $D_2$ provides reverse current protection for transistor $Q_1$. Resistors $R_1$ and $R_2$, diode $D_1$ and capacitor $C_3$ provide base drive for the transistor. The blocking oscillator operation may be summarized as follows: whenever the collector current is less than the gain times the drive of switching transistor $Q_1$, the transistor is saturated, that is it is fully on and acts like a switch. The collector current then is limited by the inductance of transformer windings P and $S_2$. As the collector current rises and approaches a value equal to the gain times the base current drive, the transistor begins to come out of saturation. This serves to reduce the voltage across $S_2$ which in turn reduces the base drive and through regenerative action turns transistor $Q_1$ off. Regeneration occurs after the field collapses in primary winding P. This returns the circuit to its initial condition so that the cycle may repeat, thereby providing a high frequency drive for arc tube 3 connected across secondary winding $S_1$. A preferred operating frequency for the 6 mm i.d. spheroidal lamp which has been described is about 26.5 kHz.

When the lamp power supply is first switched on and terminals $t_1$, $t_2$ energized, thermal switch 12 is cold and therefore closed, and filament 12 lights up immediately. The incandescent filament and thermal switch thus provide an instant-on feature at a cold start which gives light while the arc tube is warming up and its output is low. Due to its small size, a miniature metal halid vapor lamp as illustrated heats up relatively fast, and the thermal switch may open and turn off the filament in about 30 seconds or less. The light then comes entirely from the arc tube and the lamp operates at high efficacy, typically at 70 lumens per watt or better.

In the event of a current interruption of substantial duration, the lamp cools off and, when switched on again, the previously described sequence merely repeats. However, in the event of a momentary current interruption of a fraction of a second, the arc tube deionizes, and the open circuit voltage of secondary winding $S_1$ is insufficient to reignite the arc until the vapor pressure has diminished appreciably. The cooling off period prior to reignition may take 30 seconds or even more. However the combination of a miniature arc tube within a large outer envelope and a thermal switch in proximity to the arc tube and preferably juxtaposed to it as illustrated, favors a dynamic heat balance which allows the switch to cool quickly. The small size of the arc tube increases its cooling rate compared to prior art higher wattage metal or metal halide vapor lamps for two reasons: first, it has a low thermal mass (product of mass and heat capacity), and, second, its surface to volume ratio is high, being inversely proportional to radius. I have found that by biasing the thermal switch so that it opens at a temperature fairly close to its upper temperature limit in normal lamp operation, it can be made to close reliably within less than 10 seconds after arc tube extinction, generally within about five seconds of extinction. This means that in the event of an extinction, the filament will come back on within about five seconds, at most ten seconds. This is an acceptably brief interval for an outage; by contrast prior art filament-ballasted lamps would stay out for one or more minutes under such circumstances. The filament will stay on and provide light for about 25 seconds more while the arc tube cools to the point where it can be reignited by the ballast circuit. Thereafter it stays on for possibly another 25 seconds while the arc tube heats up to normal operating temperature.

Thus my invention by combining a miniature metal vapor arc tube, a standby filament and a thermal switch within a relatively large sealed outer envelope makes possible a highly efficient combination which provides light immeditaly in the case of a cold start and which provides light after an acceptably brief interval, 10 seconds or less, in the case of a hot restart necessitated by a momentary current interruption.

What I claim as new and desire to secure by Letters Patent of the United States is:

1. A combination discharge-incandescent lamp comprising a miniature arc tube, an incandescible filament and a thermal switch mounted within a sealed vitreous outer envelope, said arc tube comprising an envelope having a pair of electrodes sealed therein, said envelope having a discharge volume of 1 cubic centimeter or less and containing a fill of vaporizable metal or metal salt condensed at room temperature and vaporizing to produce a high pressure at operating temperature, the striking voltage and the light output from said arc tube being relatively low at room temperature and increasing with vaporization of said fill, current inleads sealed into said outer envelope and a base attached thereto having provision for at least three terminals, one common terminal having a connection to one side of the arc tube and to one side of the filament, a second terminal having a connection to the opposite side of the arc tube, and a third terminal having a connection to the thermal switch, said thermal switch being connected to the other side of said filament, said thermal switch being normally closed and being located in heat-receiving proximity to said arc tube, said thermal switch being biased to open only when said arc tube approaches its normal operating temperature whereby a dynamic heat balance is achieved which allows the switch to cool and reclose quickly in the event of extinction of the arc tube upon a momentary interruption of current thereto.

2. A lamp as in claim 1 wherein the bias of the thermal switch and its heat balance are correlated to achieve closure in not more than 10 seconds after extinction of the arc tube whereby to provide standby lighting from said filament after a delay not exceeding 10 seconds upon a hot restart.

3. A lamp as in claim 2 wherein the thermal switch comprises a bimetal member juxtaposed alongside said arc tube to assure rapid heating or cooling thereof consonant with ignition or extinction of said arc tube.

4. In combination, a discharge-incandescent lamp comprising a miniature arc tube, an incandescible filament and a thermal switch mounted within a sealed vitreous outer envelope, said arc tube comprising an envelope having a pair of electrodes sealed therein, said envelope having a discharge volume of 1 cubic centimeter or less and containing a fill of vaporizable metal or metal salt condensed at room temperature and vaporizing to produce a high pressure at operating temperature, the striking voltage and the light output from said arc tube being relatively low at room temperature and increasing with vaporization of said fill, current inleads sealed into said outer envelope and a base attached thereto having provision for at least three terminals, one common terminal having a connection to one side of the arc tube and to one side of the filament, a second terminal having a connection to the opposite side of the arc tube, and a third terminal having a connection to the thermal switch, said thermal switch being connected to the other side of said filament, said thermal switch being normally closed and located in heat-receiving proximity to said arc tube, and a ballast circuit having a line input side and an output side providing a regulated current, said output side being connected across said common terminal and said second terminal of the base, and said line side being connected across said common terminal and said third terminal of the base, said thermal switch being biased to open only when said arc tube approaches its normal operating temperature whereby a dynamic heat balance is achieved which allows the switch to cool and reclose quickly in the event of extinction of the arc tube upon a momentary interruption of current thereto.

5. A lamp-ballast combination as in claim 4 wherein the output side of said ballast provides a regulated current at a frequency in the range of 20 to 50 kilohertz.

* * * * *